United States Patent [19]

Torre

[11] 4,281,607

[45] Aug. 4, 1981

[54] CUTTING APPARATUS FOR SEWING MACHINES

[75] Inventor: Giancarlo D. Torre, Biassono, Italy

[73] Assignee: Rockwell-Rimoldi S.p.A., Milan, Italy

[21] Appl. No.: 175,792

[22] Filed: Aug. 6, 1980

[30] Foreign Application Priority Data

Sep. 20, 1979 [IT] Italy ..... 25837 A/79

[51] Int. Cl.[3] ..... D05B 37/04; D05B 65/00; D05B 83/00

[52] U.S. Cl. ..... 112/130; 112/261; 112/288; 112/289

[58] Field of Search ..... 112/130, 129, 285, 288, 112/289, 292, 291, 297, 261

[56] References Cited

U.S. PATENT DOCUMENTS

| | | | |
|---|---|---|---|
| 1,283,552 | 11/1918 | Peddie | 112/261 |
| 1,939,620 | 12/1933 | Ciravolo | 112/261 |
| 2,931,330 | 4/1960 | Pinkvoss et al. | 112/261 |
| 3,111,921 | 11/1963 | Kleemann et al. | 112/261 |

*Primary Examiner*—H. Hampton Hunter

[57] ABSTRACT

The invention pertains to a cutting apparatus for sewing machines disposed downstream of the machine's sewing zone. The apparatus includes a cutting blade and a protective guard for the blade both of which have independent actuating devices. The actuating devices are effective in moving the guard and blade between one position which provides clearance for the workpieces being advanced along the machine's work surface and another position where they are operatively associated with the workpieces. A timing element is operatively associated with both actuating devices and is effective in causing the protective guard to be moved toward the workpieces prior to movement of the blade.

11 Claims, 2 Drawing Figures

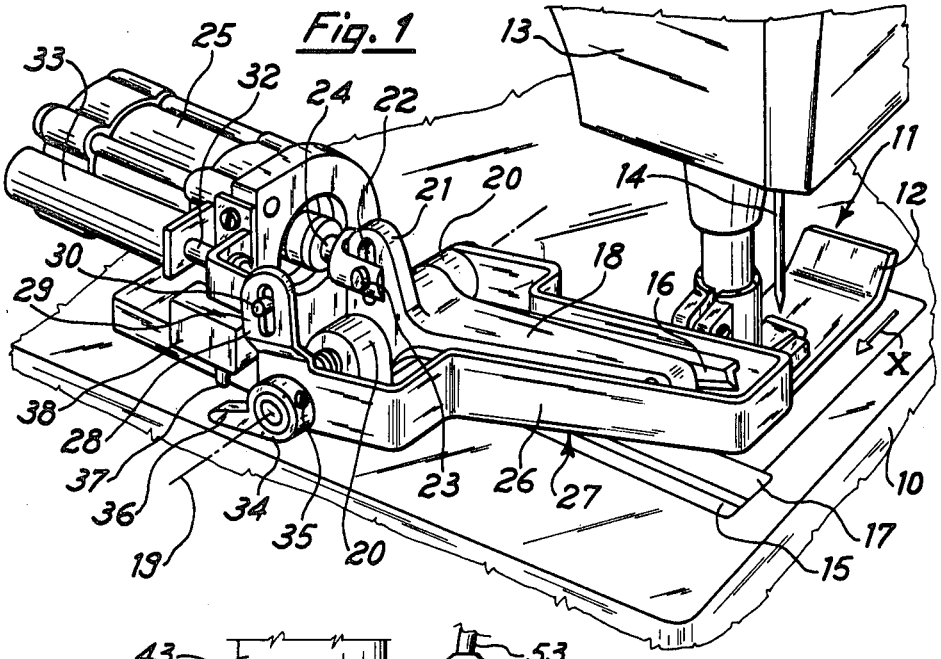
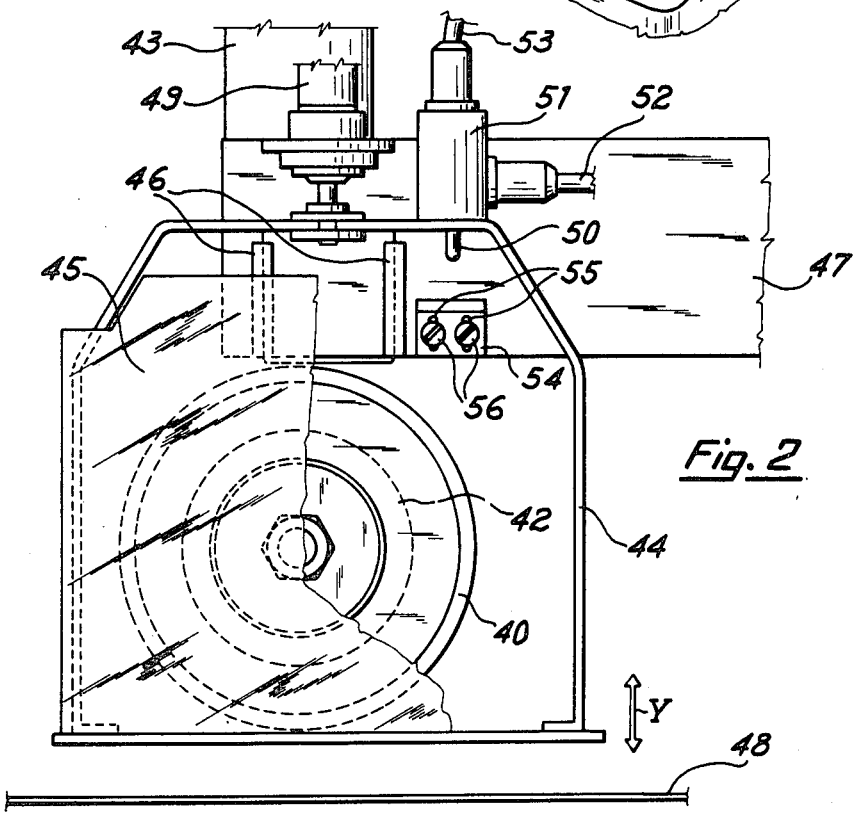
Fig. 2

CUTTING APPARATUS FOR SEWING MACHINES

BACKGROUND OF THE INVENTION

The present invention pertains to a cutting apparatus for sewing machines which serves to sever chains of stitches that interconnect successively sewn workpieces as they leave the sewing zone as well as the cutting of tapes or other attachments applied to the workpieces or when desired, the actual cutting of the workpieces.

More particularly, the invention relates to a cutting apparatus for sewing machines having a work surface over which the workpieces are caused to advance during seaming and which is provided with a fixed counter-blade mounted in said work surface downstream of the machine's stitching instrumentalities. The apparatus also includes a movable blade pivotably mounted above the work surface and a means for actuating said movable blade so that it is pivoted downwardly a distance to intersect the path of travel of the workpieces and to a position of operative engagement with the fixed counter-blade. Additionally, this movable blade is usually provided with some form of protective guard surrounding the area of its travel.

With the known cutting apparatuses of this type, it is obvious that the protective guards serve to prevent injury to the fingers of an operator while the movable blade is performing its intended function. It is also obvious that these protective guards should be arranged so as to provide a shield in all possible areas that an operator could accidentially come into contact with the movable blade.

The known forms of protective guards have what is considered certain disadvantages during seaming, cutting or the separation of one workpiece from another due to the reduced amount of free space between the lower edge of the guard and the worksurface of the machine so that frequently there is an interference with the proper advance of a workpiece. As is well known, workpieces are often partially complete with the addition of attachments sewn thereon, and for this reason cannot always be advanced in a sufficiently flattened state to prevent an interference with the known types of protective guards.

Although regulations require that such guards be used with this type of cutting apparatus, it is common knowledge that operators frequently remove them for obvious reasons of preventing such interferences and to increase the number of pieces they can produce in a given period of time.

SUMMARY OF THE INVENTION

An object of the present invention is to provide a cutting apparatus for sewing machines of the type described above, in which positive protection of the operator is provided without possible interference with the workpieces as they are advanced to the area of the movable knife and its protective guard. This object is accomplished by providing a cutting apparatus having a protective guard mounted in a manner whereby in timed sequence with movement of the movable blade, it is caused to move in a direction parallel with said movable blade. The guard is movable by any suitable actuating means from a first position where its lower edge is disposed in spaced relation above the machine's working surface to a second position where its lower edge is located relatively close to said working surface. The movable blade is provided with an actuating means that is operatively associated with the protective guard's actuating means in a manner whereby said blade can only be actuated after said guard has reached a predetermined position during its movement toward its operating or second position.

In other words, a protective guard is provided which can be actuated either automatically or manually between an elevated position where there is no possible chance of an interference with a workpiece and a lowered position whereat it provides positive protection against injury to an operator. With the actuating means of both the movable blade and the protective guard being operatively associated, a means is provided whereby said movable blade is unable to perform its intended function until it receives a signal indicating that said protective guard has arrived at a pre-determined position whereat the operator will be fully protected from the cutting action of said movable blade.

Upon completion of the cutting operation, both the movable blade and the protective guard are caused to return to their inactive or elevated positions and they need not follow a sequence that is the reverse of that utilized when they were actuated.

These and other objects of the invention will become more fully apparent by reference to the appended claims and as the following detailed description proceeds in reference to the figures of drawing wherein:

BRIEF DESCRIPTION OF THE DRAWING

FIG. 1 is a perspective view of a portion of a sewing machine showing one form of cutting apparatus according to the invention applied thereto; and FIG. 2 is a view in side elevation of a modified form of cutter and protective guard.

DESCRIPTION OF THE PREFERRED EMBODIMENT

In the drawing, FIG. 1 shows a portion of a sewing machine including a conventional base plate 10 which defines a horizontal work surface generally indicated by numeral 11 that serves in a known manner for supporting workpieces as they are caused to advance to the stitching zone beneath the machine's presser foot 12. The presser foot 12 along with the machine's needle that is depicted by numeral 14 are supported in a conventional manner by the free end of an arm 13 that forms a part of the supporting frame of the machine. Downstream of the stitching zone, which is in the direction of the indicating arrow X in FIG. 1, the work surface 11 is provided with an opening 15 which traverses the direction of travel of the workpieces as they leave the stitching zone. This opening 15 provides a means which permits an elongated movable cutting blade 16 to travel beyond the upper surface of the work surface 11. A counter-blade 17 is fixedly mounted in the opening 15 and is arranged to cooperate with the blade 16 to provide a scissor-like cutting action during the latter's intended function which will be further described hereinafter. Blade 16 is attached to one side of a support arm 18 that is pivotably supported on a shaft 19. This shaft 19 is supported in a bracket 20 that is mounted on the work surface 11. The support arm 18 is provided with an integrally formed and upwardly directed lug 21 having an elongated opening 22 through which a pin 23 carried in the bifurcated end of a piston rod 24 is caused to extend. Piston rod 24 forms a part of a piston-cylinder unit 25 which may be of the hydraulic or pneumatic type and reciprocating movement of said piston rod will by means of pin 23 moving within the limits of the elongated slot 22 cause the support arm 18 to pivot a preselected distance first in one direction and then the other. The pre-selected distance which the support arm 18 is caused to travel is sufficient to cause the blade 16 to cooperate with the counter-blade 17 and perform the necessary cutting action required for the particular workpieces which are advancing successively below the presser foot 12 and said blade 16. A protective guard 26 is disposed in operative association with the blade 16 and the embodiment shown in FIG. 1 has a configuration which is substantially U-shaped and is positioned so as to surround the danger areas of said blade 16. This protective guard is supported independently of the support arm 18 by means of aligned openings (not shown) adjacent the ends thereof which provide a means for pivtably supporting it on the shaft 19. By a means yet to be described the protective guard 26 can be lowered in timed sequence with the blade 16 from the raised position shown in FIG. 1 to a position whereat it provides positive protection against injury to an operator by said blade 16.

Referring again to FIG. 1 one end of the protective guard 26 is provided with an integrally formed and upwardly directed ear 28 having an elongated opening 29 through which a pin 30 is caused to extend. This pin 30 is connected to a piston rod 32 of a second piston-cylinder unit 33 of the double acting type and is adapted to control the movements referred to above of the protective guard 26. A cam element 34 is assembled on one end of shaft 19 by means of a set screw 35 and is disposed in contiguous relation with one side of the protective guard 26. This cam element 34 is provided with a projecting finger 36 and during the lowering of the protective guard 26, said finger 36 is caused to pivot upwardly until it engages a plunger 37 of a switching relay 38 which when actuated, provides a signal to initiate actuation or the lowering of the blade 16 by the piston-cylinder unit 25. In other words, the protective guard 26 can be lowered manually by the operator or by a suitably timed automatic device on the machine and when it reaches a position where there is no possibility of an operator coming in contact with the blade 16, the finger 36 of the cam element 34 is then and only then effective in initiating actuation of said blade 16 by its engagement with the plunger 37 of the switching relay 38. The switching relay 38 is fixedly mounted as are the piston-cylinder units 25 and 33 relative to the work surface 22 and engagement of the plunger 37 by the finger 36 can be timed to occur at the lower end of the path of travel of the protective guard 26 or just prior thereto provided the signal for the actuation of the blade 16 is only given when said guard has travelled a sufficient distance to provide maximum safety for the operator. Movement of the blade 16 and the protective guard 26 to their initial or inactive positions can occur simultaneously or may be accomplished by a sequence reverse to that by which they were activated. The manner in which the protective guard 26 and blade 16 are actuated provide positive assurance of safety for the operator and when these elements are in their inactive positions, sufficient clearence is provided so that the workpieces are cuased to advance on the work surface 11 free of any possible interference.

Referring now to FIG. 2, a modification of the cutting apparatus according to the invention is shown in which a cutting blade 40 of the circular type is utilized and which is driven by any suitable motor indicated by numeral 42. This blade 40 is lowered and raised by means of a piston-cyliinder unit 43 in a manner which has not been shown in detail for it is considered that the mechanism for performing such a function is well known. Additionally, the motor 42 may be of the type which operates continuously or that is actuated when the blade is lowered to perform its intended function. As shown in FIG. 2 the blade 40 is provided with a protective guard having a depending and substantially U-shaped frame 44 with side walls 45 (one only shown) which are preferably formed from a suitable transparent material and mounted on said frame so as to prevent accidental contact with said blade. The frame 44 is mounted on guides 46 provided on a fixed support member 47 which enables it to be moved either in an upwardly or downwardly direction as shown by the indicating arrow Y. This movement is perpendicular to the work surface indicated by numeral 48 and is accomplished by means of the piston rod of a pneumatic cylinder 49. The signal for initiating the lowering of the blade 40 is provided by a plunger 50 which forms a part of a pneumatic valve 51 that is mounted on the frame 44. When the plunger 50 is depressed by a means yet to be described, the valve 51 is opened and permits fluid from a supply line 52 to flow through a feed line 53 to the piston-cylinder unit 43. The plunger 50 is depressed or actuated by means of an abutment 54 fixedly mounted on the support member 47.

The means for mounting this abutment 54 include a pair of spaced and parallel openings 55 therein and through which locking screws 56 extend. These openings 55 provide a means for selectively positioning the abutment so that it will engage the plunger 50 at the most desirable time to effect the lowering of the protective guard prior to the lowering of the blade 40. The protective guard is lowered a pre-selected distance prior to providing a signal for actuating the blade 40 so that the necessary precautionary measures are had to prevent possible contact with said blade by the operator. The blade when lowered is caused to extend a limited amount into a slot (not shown) provided in the work surface 48.

In their raised or inactive positions, the protective guard and the blade 40 are at a sufficient distance above the work surface 48 so that the workpieces are capable of advancing without interference.

Although the present invention has been described in connection with a preferred embodiment and a single modification thereof, it is to be understood that other modifications and variations may be resorted to without departing from the spirit and scope of the invention as those skilled in the art will readily understand. Such modifications and variations are considered to be within the purview and scope of the invention and the appended claims.

I claim:

1. A cutting apparatus for sewing machines having a sewing zone including a presser foot and cooperating needle and a work surface on which workpieces are advanced to and beyond the sewing zone, said cutting apparatus comprising:

(a) a cutting member supported on the machine downstream of the sewing zone;

(b) a first actuating means for moving said cutting member between a raised position and one of operative association with the workpieces being advanced on the work surface;

(c) a protective guard mounted on the machine in a manner to substantially surround said cutting member;

(d) a second actuating means connected to said protective guard for moving the same between the positions travelled by said cutting member; and (e) means interconnecting said first and second actuating means for initiating movement of said protective guard to its position of operative association with the workpieces prior to movement of said cutting member thereto.

2. The cutting apparatus according to claim 1 wherein said cutting member defines an elongated cutting blade (16) pivotably supported above the work surface and extending in a direction to traverse the direction of advance of the workpieces.

3. The cutting apparatus according to claim 2 wherein said apparatus includes means defining an opening (15) in the work surface with a counter-blade (17) fixedly mounted therein for cooperating with said cutting blade 16 and provide a scissor cutting action upon movement of said blade to its position of operative association with the workpieces.

4. The cutting apparatus according to claim 3 wherein said first actuating means includes a support arm 18 pivotably mounted on said work surface for supporting said cutting blade 16 and a piston-cylinder unit (25) operatively connected to said support arm.

5. The cutting apparatus according to claim 4 wherein said protective guard defines a substantially U-shaped bar member pivotably mounted in operative association with said cutting blade (16).

6. The cutting apparatus according to claim 5 wherein said second actuating means includes:

(a) an integrally formed and upwardly directed ear (28) on one end of said U-shaped bar member; and (b) a piston-cylinder unit (23) operatively connected to said ear.

7. The cutting apparatus according to claim 5 wherein said means for initiating movement of said protective guard includes:

(a) a cam element (34) mounted in contiguous relation with one side of said U-shaped bar member; and (b) a switching relay 38 activated by said cam element (34) during movement of said bar member to its position of operative association with the workpieces.

8. The cutting apparatus according to claim 1 wherein said cutting member defines a rotatably driven circular cutting blade (40).

9. The cutting apparatus according to claim 8 wherein said protective guard includes:

(a) a depending U-shaped frame (44); and (b) side walls (45) of transparent material attached to said frame (44).

10. The cutting apparatus according to claim 9 wherein said second actuating means define a pneumatic cylinder 49 having a piston rod operatively connected to said U-shaped frame (44).

11. The cutting apparatus according to claim 10 wherein said means for initiating movement of said protective guard includes:

(a) a pneumatic vlave 51 mounted on said U-shaped frame (44);

(b) a plunger (50) for controlling and forming a part of said valve; and (c) an abutment (54) for engaging said plunger to actuate said valve during movement of said protective guard to its position of operative association with the workpieces.

* * * * *